US006884003B2

(12) United States Patent
Horton, III

(10) Patent No.: US 6,884,003 B2
(45) Date of Patent: Apr. 26, 2005

(54) MULTI-CELLULAR FLOATING PLATFORM WITH CENTRAL RISER BUOY

(75) Inventor: Edward E. Horton, III, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 0 days.

(21) Appl. No.: 10/616,400

(22) Filed: Jul. 9, 2003

(65) Prior Publication Data

US 2004/0253059 A1 Dec. 16, 2004

Related U.S. Application Data

(60) Provisional application No. 60/478,870, filed on Jun. 16, 2003.

(51) Int. Cl.[7] ..... B63B 35/44

(52) U.S. Cl. ..... 405/224.2; 405/224; 405/223.1

(58) Field of Search ..... 405/223.1, 224, 405/224.2, 224.4; 114/264, 265; 166/355

(56) References Cited

U.S. PATENT DOCUMENTS 4,217,848 A 8/1980 Meyer-Haake
4,913,238 A * 4/1990 Danazcko et al. ..... 405/223.1
5,150,987 A * 9/1992 White et al. ..... 405/224
5,439,321 A 8/1995 Hunter
6,375,391 B1 * 4/2002 B.o slashed.rseth et al. ..... 405/224.4
6,746,182 B1 * 6/2004 Munk et al. ..... 405/224.2

* cited by examiner

*Primary Examiner*—Sunil Singh
(74) *Attorney, Agent, or Firm*—Klein, O'Neill & Singh, LLP; Howard J. Klein

(57) ABSTRACT

A semi-submersible floating platform for offshore drilling and/or production of petroleum product from the seabed includes a base having a first moon pool; a plurality of vertical outer buoyancy columns extending upwardly from the base; a deck structure supported by the buoyancy columns and having a second moon pool; a central columnar buoyancy apparatus having a lower portion guided within the first moon pool and an upper portion guided within the second moon pool; and at least one vertical riser passing through the buoyancy apparatus. Each riser has a lower portion that is horizontally restrained within the buoyancy apparatus below the center of gravity thereof. In a preferred embodiment, the platform includes at least two vertical risers attached to a single buoyancy apparatus.

18 Claims, 6 Drawing Sheets

MULTI-CELLULAR FLOATING PLATFORM WITH CENTRAL RISER BUOY

CROSS-REFERENCE TO RELATED APPLICATION

This application claims the benefit, under 35 U.S.C. Section 119(e), of co-pending U.S. provisional application No. 60/478,870; filed Jun. 16, 2003.

FEDERALLY SPONSORED RESEARCH OR DEVELOPMENT

Not Applicable

BACKGROUND OF THE INVENTION

The present invention relates to offshore platforms, and specifically to offshore platforms designed for dry tree applications. More particularly, the present invention relates to a new production and/or drilling riser system used in deep draft semi-submersible platforms.

Conventional dry tree offshore platforms are low heave floating platforms, such as spars, TLPs (Tension Leg Platforms), and deep draft semi-submersible platforms. These platforms are able to support a plurality of vertical production and/or drilling risers. These platforms may comprise a well deck, where the surface trees (arranged on top of the riser) will be located, and a production deck where all the crude oil will be manifolded and sent to a processing facility to separate water, oil and gas. In conventional dry tree offshore platforms, vertical risers running from the well head to the well deck are supported by a tensioning apparatus. These vertical risers are called Top Tensioned Risers (TTRs).

One prior art TTR design uses active hydraulic tensioners to independently support the risers. Each riser extends vertically from the wellhead to the well deck of the offshore platform. The riser is supported by active hydraulic cylinders connected to the well deck of the offshore platform, allowing the platform to move up and down relative to the risers and thus partially isolating the risers from the heave motions of the hull. A surface tree is connected on top of the riser, and a high pressure flexible jumper connects the surface tree to the production deck. As tension and stroke requirements increase, these active tensioners become prohibitively expensive. Furthermore, the loads have to be supported by the offshore platform.

A second prior art design uses passive buoyancy cans to independently support the risers. Each riser extends vertically from the wellhead to the well deck of the offshore platform. The riser passes from the wellhead through the keel of the floating platform into a stem pipe, on which buoyancy cans are attached. This stem pipe extends above the buoyancy cans and supports the platform to which the riser and the surface tree are attached. A high pressure flexible jumper connects the surface tree to the production deck. Because the risers are independently supported by the buoyancy cans (relative to the hull), the hull is able to move up and down relative to the risers, and thus the risers are isolated from the heave motions of the offshore platform. The buoyancy cans need to provide enough buoyancy to support the required top tension in the risers, the weight of the can and the stem pipe, and the weight of the surface tree. With increased depth, the buoyancy required to support the riser system will also increase, thereby requiring larger buoyancy cans. Consequently the deck space required to accommodate all the risers will increase. Designing and manufacturing individual buoyancy cans for each riser is also costly.

Offshore environmental conditions are often harsh. Actions of wind, waves and currents on an offshore structure can have severe effects, especially in the layer of the sea between the surface and a depth of about 150–300 ft. (about 45 m to about 90 m) which is called the "splash zone". These actions attenuate with the water depth. In deep draft semi-submersible platforms, the vertical risers are subjected to the effects of high waves and current forces near the surface, which puts strain on the risers and can lead to VIV (Vortex Induced Vibrations). Consequently, in both of the aforementioned designs, each riser must be provided with strakes to prevent or minimize VIV, thereby increasing manufacturing costs.

A third prior art design, exemplified by U.S. Pat. Nos. 5,439,321 and 4,913,238, proposes to connect all the TTRs to a single (independent from the work platform) buoyancy apparatus in order to create a kind of small well deck TLP (Tension Leg Platform) to be received in a conventional semi-submersible platform. The small well deck TLP will be anchored with tendons connected to the outer periphery of the buoyancy apparatus. The well deck TLP is not dependent from the floating platform. In the apparatus disclosed in U.S. Pat. No. 5,439,321 the well deck TLP is connected to the floating platform through a cross springs mooring system, and in the apparatus disclosed in U.S. Pat. No. 4,913,238, through centralizer dollies arranged at the bottom of the floating platform. This device restrains the TLP partially horizontally; however the TLP is still able to rotate relative to the platform. The well deck TLP through this anchoring system has very good motion characteristics; however the conventional semi-submersible platform has large motions which will be transmitted to the well deck TLP, and the tendon and riser system must be designed to withstand these horizontal and pitch motions as well as large impact loads between the two floating vessels. Furthermore, as the conventional semi-submersible platform undergoes large motions, long, flexible jumpers to carry crude oil from the well deck TLP to the production deck on the semi-submersible platform are required to absorb the large relative motions between the two vessels. Finally, the vertical risers are connected only in the upper part of the single buoyancy apparatus. Nothing is proposed for horizontal restraint of the motion of the risers within the buoy.

SUMMARY OF THE INVENTION

The present invention addresses the problems just described and proposes a new passive tensioning system for Top Tensioned Risers in a deep draft semi-submersible platform.

In a first aspect, the present invention is a deep draft semi-submersible platform for drilling and/or production, the floating platform comprising:

- a base having a first moon pool;
- a plurality of buoyant vertical support columns arranged on the base;
- a deck structure supported by the columns and having a second moon pool; and
- a riser system comprising a single buoyancy apparatus having upper and lower parts, supporting at least two vertical risers;
- wherein the single buoyancy apparatus is guided at a lower location by the first moon pool and at an upper location by the second moon pool; and
- wherein the vertical risers are attached to the single buoyancy apparatus in the upper part of the buoyancy apparatus and are at least horizontally restrained in the lower part of the buoyancy apparatus.

In a second aspect, the present invention is a method for installing a floating deep draft semi-submersible platform comprising the following steps:

(a) providing an assembly comprising a buoyant base having a plurality of vertical outer buoyancy columns extending upwardly therefrom, and a central columnar buoyancy apparatus guided centrally within the base, the central columnar buoyancy apparatus being movable vertically relative to the base between an upper position and a lower position;

(b) towing the assembly at a shallow draft to a first site with the central columnar buoyancy apparatus in its upper position;

(c) ballasting down the central columnar buoyancy apparatus to its lower position;

(d) ballasting down the base to a first draft such that the outer buoyancy columns extend just above the sea surface;

(e) floating a deck structure over the base, the outer buoyancy columns, and the central columnar buoy;

(f) deballasting the outer columns to lift the deck structure;

(g) deballasting the central columnar buoyancy apparatus to raise it to its upper position in which it engages the deck structure to form a platform;

(h) towing the platform to a second site at an intermediate draft;

(i) ballasting down the platform to an operational draft; and (j) anchoring the platform to the seabed.

DETAILED DESCRIPTION OF THE INVENTION

Figure 1A:
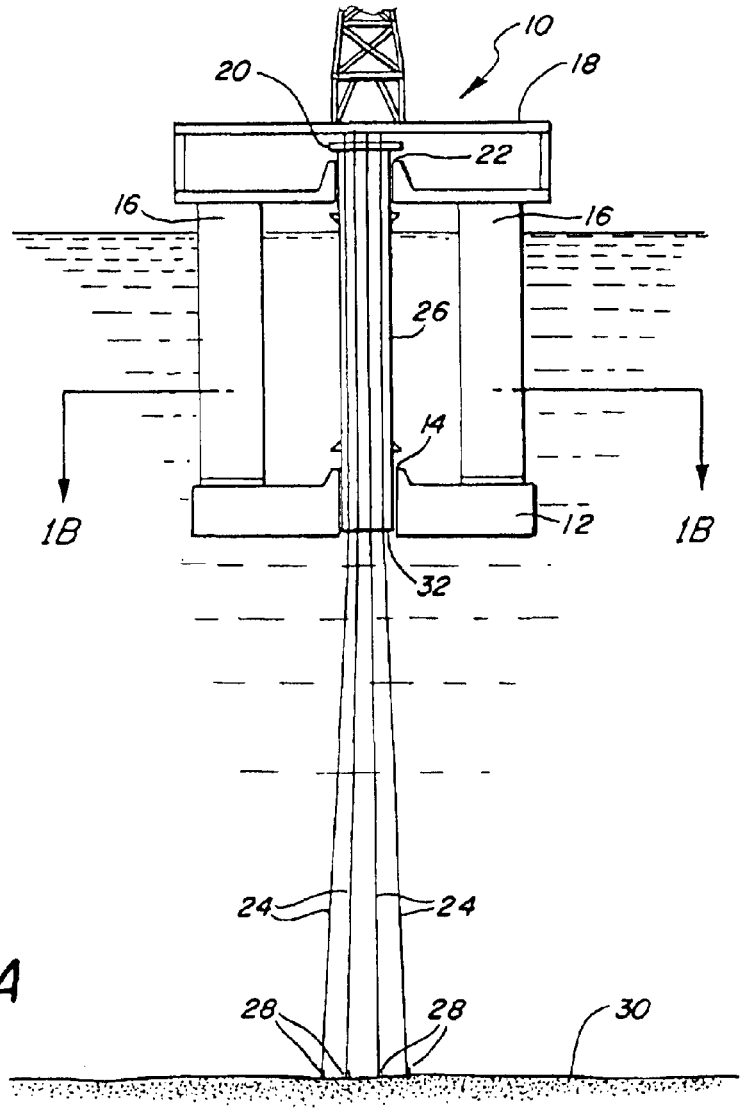
FIG. 1A is a simplified elevational view of a preferred embodiment of the invention.
Figure 1B:
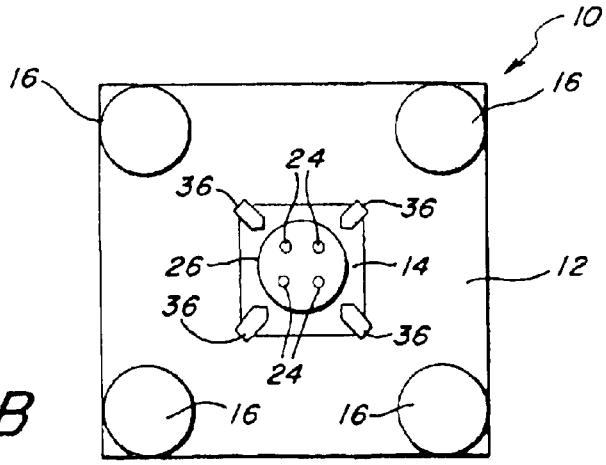
FIG. 1B is a cross-sectional view taken along line 1B—1B of FIG. 1A.

FIGS. 1A and 1B show a deep draft semi-submersible platform 10 comprising a buoyant base 12 with a first moon pool 14 (which can be circular, rectangular, etc.), four outer buoyant vertical columns 16 (although any number greater than two can be used), a production deck 18 supporting the process equipment, the quarters and utilities, and a drilling or well deck 20, with its associated equipment (if need be) and having a second moon pool 22. The deep draft semi-submersible platform has a draft of at least 150 ft. (45 m), providing it with a low heave response, and low motion responses to environmental loads (wind, waves and currents). These motion characteristics allow the platform to support a vertical riser system (Top Tensioned Risers), described in more detail below. Alternatively, the deep draft semi-submersible platform 10 can be a self-installing platform or an extended draft platform, as disclosed in U.S. Pat. No. 6,020,040. The deep draft semi-submersible platform is anchored on the sea bed with mooring lines (not shown), which may be either a taut leg mooring system or conventional catenary mooring, to limit its horizontal offset.

The riser system comprises a plurality of vertical risers 24 supported by a riser buoyancy apparatus that is embodied as a central columnar buoy 26 (which may comprise either a large single buoyancy can or a multi-cellular buoyancy apparatus) received within the floating platform 10. A novel feature of the present invention is that the columnar buoy 26 is received in and guided within the two moon pools 14, 22 of the floating platform 10. In this way, the buoy 26 is guided at an upper location in the production deck 20 and a lower location in the base 12, and is thus restrained by the floating platform for horizontal and rotational (about horizontal axes) movements. Furthermore, since the buoy 26 is guided within the moon pools 14, 22, the impact loads between the floating platform and the buoy 26 due to wave and current actions on the floating-platform are reduced.

The risers 24 extend from their respective wellheads 28 on the seabed 30 to the well deck 20 located on top of the buoy 26. The risers 24 enter the buoy 26 at its bottom or keel 32 through a horizontal restraint apparatus that is described below in connection with FIG. 4. The risers 24 are then attached to the top of the buoy 26 where the well deck 20 is located. Surface trees (not shown) on the well deck 20 are connected to the tops of the risers 24, and the surface trees and jumpers (not shown) are used to carry the petroleum product from the well deck 20 to the production deck 18 on the work platform where the product will be processed. In a specific example, the well deck 20 is supported directly by the single buoy 26. However, as in prior art systems, the well deck 20 can be supported by the floating platform itself, being free to move up and down relative to the surface trees 34 and the risers 24.

As can be seen in FIG. 1B, a lower plurality of buoy guides 36 (in this example, four guides, but three or more can be used, depending on the load to be absorbed by the guides) extends into the lower moon pool 14 from the base 12. Preferably, these guides are compliant. The lower buoy guides 36 significantly reduce the gap between the buoy 26 and the base 12 within the lower moon pool 14 for further reducing the impact loads. A similar upper plurality of compliant buoy guides 36 (not shown) extends into the upper moon pool 22 from the production deck 18 to reduce the gap between the buoy 26 and the production deck 18. As described more fully below, each of the buoy guides 36 comprises a steel projection coated with Teflon or polypropylene. Preferably, the buoy guides 36 are configured and located to be in constant, uninterrupted contact with the buoy 26. In order to do so, the buoy guides 36 must be compliant enough to allow the installation of the central columnar buoy 26, and also to allow the relative vertical motions between the buoy 26 and the floating platform, while also accommodating any buoy diameter variances from its nominal diameter due to manufacturing tolerances. The guides 36 may include, at their free ends, a wear pad mounted on a compliant support (an elastomeric block or a leaf spring), as disclosed and claimed in commonly-assigned U.S. Pat. No. 6,679,331, the disclosure of which is incorporated herein by reference. As described in more detail below, to further reduce the friction between the buoy 26 and the guides 36, a wheel allowing vertical movement of the buoy 26 may also be mounted on a compliant support.

With this arrangement, the present invention proposes to make the single buoy 26 completely dependent from the deep draft semi-submersible platform 10. The single buoy 26 will move with the platform except for heave motions, and the interaction between the buoy 26 and the platform will significantly ameliorate the motions of the platform, as discussed below in connection with FIG. 5.

Figure 2A:
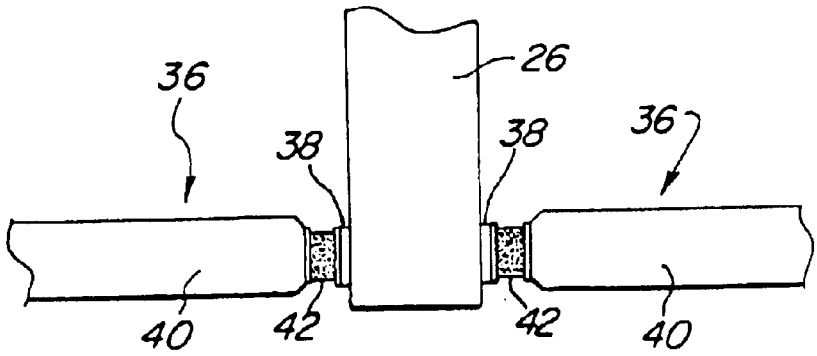
FIGS. 2A, 2B, and 2C are elevational views showing different types of compliant guides used in the invention.
Figure 2B:
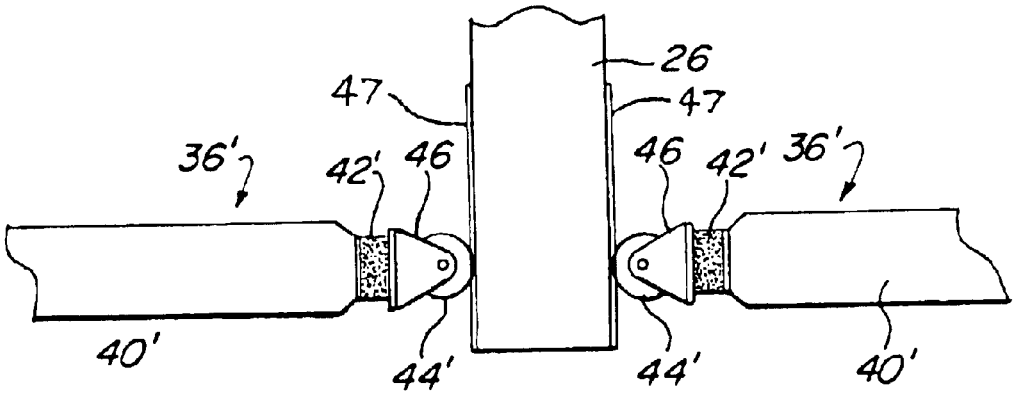
Figure 2C:
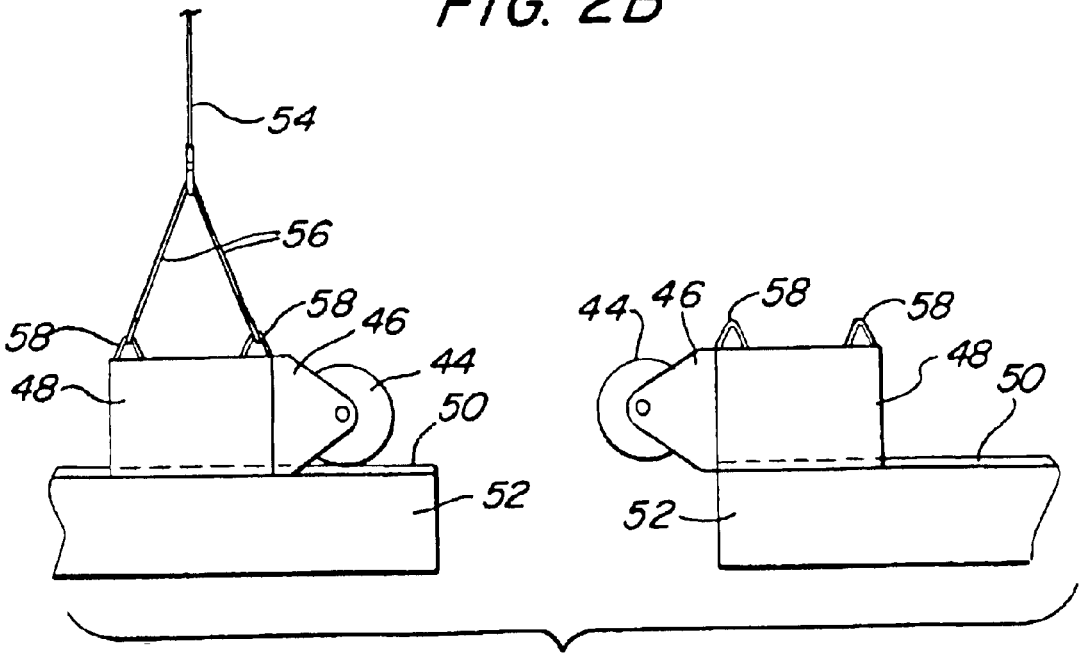

FIGS. 2A to 2C show different examples of compliant buoy guides 36. FIG. 2A shows a standard compliant guide 36 comprising a wear pad 38 (preferably made of a suitable steel) with a contact surface formed by a coating or layer of PTFE or polypropylene. The wear pad 38 is supported on the free end of a steel projection 40, the other end of which is fixed to the base 12 or the production deck 18. In between the steel projection 40 and the wear pad 38, a compliant element 42 is arranged to allow the guide 36 to absorb impact loads and to accommodate buoy diameter variances. The compliant element 42 preferably comprises one or more elastomeric blocks, as shown in FIGS. 2A and 2B; alternatively it may comprise one or more leaf springs (not shown). The stiffness of the compliant element is selected, depending on the environmental conditions, and it may comprise either a single stiffness compliant system (one grade of elastomer or a constant stiffness leaf spring) or a multi-stiffness compliant system in order to provide the guide with anon-linear stiffness to absorb loads of different magnitudes (several grades of elastomer, or leaf springs of several different stiffnesses) as suggested in U.S. Pat. No. 6,679,331.

FIG. 2B shows an alternative guide 36', in which the wear pad is replaced by a wheel and rail assembly. A wheel or roller 44 is rotatably mounted in a pair of journals 46 (only one of which is shown) supported at the free end of a steel projection 40' through a compliant element 42'. The wheel 44 allows the vertical relative motion between the platform and the buoy 26, and it further reduces the friction between the two floating elements. Each wheel 44 rides on a corresponding vertical rail 47 arranged on the outer surface of the buoy 26. Another advantage of the wheel/rail assembly is that it prevents rotation of the buoy 26 about its vertical axis. The wheel/rail assembly may provide a steel-to-steel contact (as friction is already reduced by the use of the wheel) or the wheel 44 and/or the rail 47 may be coated with PTFE or polypropylene.

FIG. 2C shows another embodiment for the guides (which can apply to both alternatives described above). In this embodiment, the guide comprises a guide module 48 riding on a horizontal rail 50 disposed longitudinally along the upper surface of the base 12 of the work platform 18, thereby allowing the module 48 to slide from a storage position (out of contact with the buoy 26) to an operational position (in contact with the buoy 26. The module 48 includes a conventional locking mechanism (not shown) that can be operated by a diver or a remote operating vehicle (underwater robot) (not shown). The module 48 can be deployed, via a cable 54 and harness 56, from the platform using a crane (not shown) on the platform. To this end, the module 48 is provided with one or more harness attachment elements 58 on its upper surface. The module 48 is installed on the rail 50, and then slid toward the buoy 26. The module 48 is then locked into its operation position on the support element 52 to secure it to the base or work platform when the required preload is achieved. This arrangement simplifies the installation of the buoy 26 without the risk of damage to the compliant guides.

FIGS. 3A to 3D show different alternatives for the riser buoyancy apparatus. The riser buoyancy apparatus may comprise a single buoy, or multiple buoys closely spaced and connected to each other by webs.

Figure 3A:
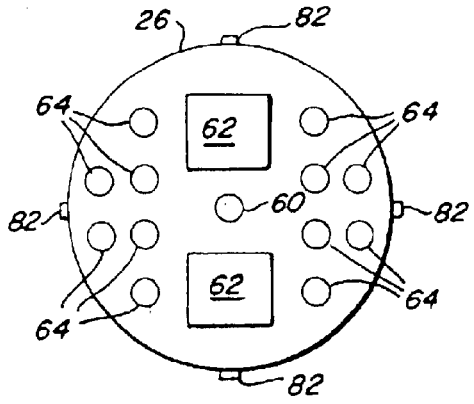
FIGS. 3A, 3B, 3C and 3D show different configurations for the buoy used in the invention.

FIG. 3A shows a single buoy 26 having a central passage 60 to receive a drilling riser or a tendon (not shown). Two moon pools 62 are arranged on either sides of the central passage 60. A plurality of production riser passages 64 is arranged in the remaining interior space of the buoy 26. In this arrangement, the risers pass through the void compartments of the buoyancy apparatus, which may require additional welding procedures to ensure sealing efficiency.

Figure 3D:
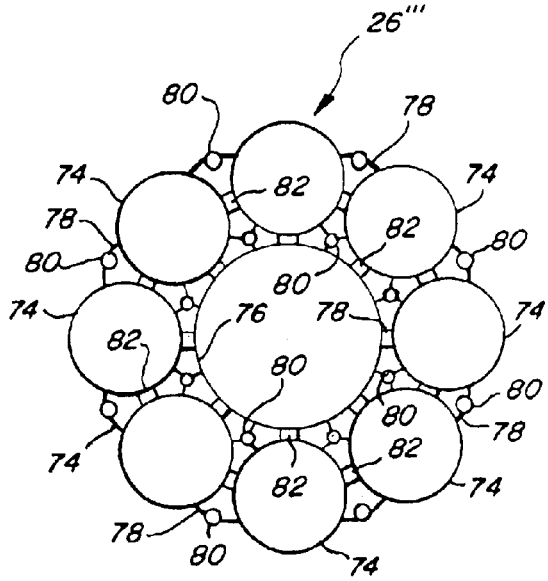
Figure 3B:
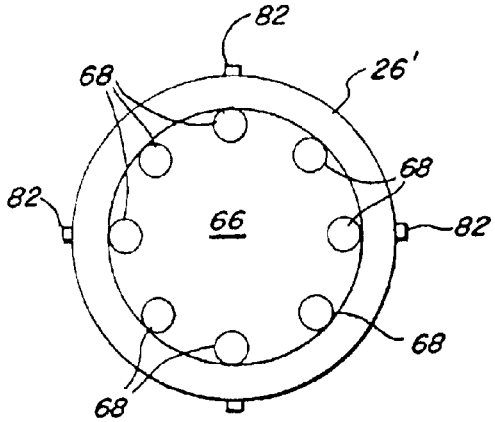

FIG. 3B shows a single buoy 26' provided with a large center well 66. The center well 66 includes a plurality of riser passages 68 for the different risers, leaving enough room to receive a drilling riser (not shown) in the center, or provide a moon pool for lowering subsea hardware (not shown). In this embodiment, the risers do not pass through the void compartments of the buoyancy apparatus.

Figure 3C:
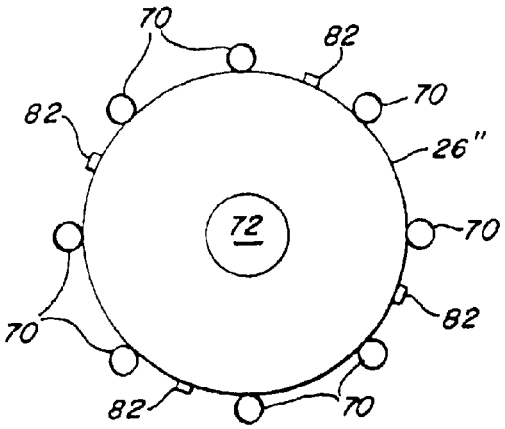

FIG. 3C shows a single buoy 26", wherein riser passages 70 are arranged on the outer surface of the buoy 26". A center well 72 can be arranged to act as a moon pool or to receive a drilling riser or tendon (not shown).

FIG. 3D shows a multiple cell buoyancy apparatus 26''', comprising a plurality of vertical outer tubular buoys 74, closely spaced and connected to each other and to a central tubular buoy 76 by a network of vertically-elongated webs 78. A plurality of risers 80 is arranged in the interstices defined between the tubular buoys 74, 76. If need be, the central buoy 76 can be designed to act as a center well or to receive a drilling riser or tendon (not shown).

The embodiment of FIG. 3D solves some problems inherent in the single buoy embodiments. For example, to achieve a high degree of compartmentalization, a single buoy must be sub-divided with a large number of bulkheads, thereby increasing its cost of manufacture. Furthermore, because the risers and/or tendons pass through the buoy, the intersections between the risers and the buoy and its bulkheads must be sealed by welding, using a heavy welding procedure. In the embodiment shown in FIG. 3D, by contrast, the vertically restrained buoyancy apparatus 26''' comprises an assembly of a plurality of vertical tubular buoys 74, 76, closely spaced and connected together by the vertically-elongated webs 78. This arrangement achieves a high degree of compartmentalization with few bulkheads and thus at a reduced cost. Furthermore, the risers can be arranged around the exteriors of the tubular buoys 74, 76 (i.e. in the interstices defined between them), and will therefore not have to pass through the buoyancy compartments, thereby avoiding the need to take further actions to ensure effective sealing.

In each of the buoyancy apparatus alternatives described above, wear pads or rails 82 can be arranged on the outer periphery of the buoy at the level of the guide apparatus to reduce friction.

Figure 4:
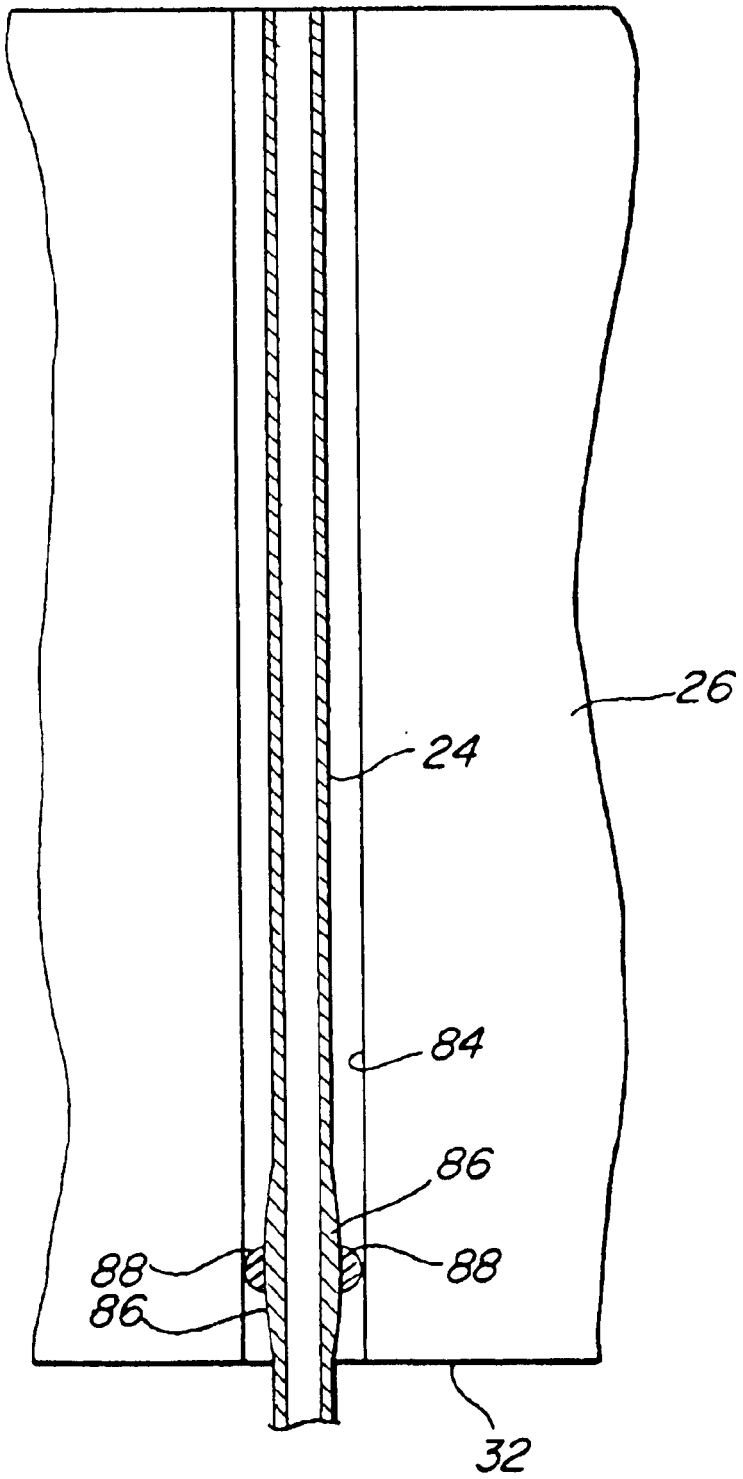
FIG. 4 shows a detailed view of the riser system and the single buoy.

FIG. 4 shows one way to horizontally restrain the riser 24 in the lower part of the buoy 26. As will be explained below, it is an important feature of the invention that at least the lower portion of the riser 24 is horizontally restrained by the buoyancy apparatus. (Alternatively, the riser 24 and the buoyancy apparatus may be attached to each other). The riser 24 is received in a vertical passage 84 disposed through the buoy 26, or in a stem (not shown) connected to the buoyancy apparatus. The riser 24 is attached to the top surface of the buoyancy apparatus and it is guided in the lower part through a keel joint, so that the riser 24 is substantially in contact with the buoy passage 84 or stem, so that loads (weight) of the risers will be transmitted to the buoyancy apparatus through this keel joint. In this specific example, the keel joint comprises two outwardly-tapered (radially thickened) conjoined riser sections 86 to increase the section modulus of the riser 24 in this area, and a ball wear insert 88, at the juncture of the tapered riser sections 86. The ball wear insert 88 is able to move up and down in the passage 84, and it allows some flexion about the keel joint, so that bending loads due to platform motions will be absorbed by the keel joint.

Figure 5:
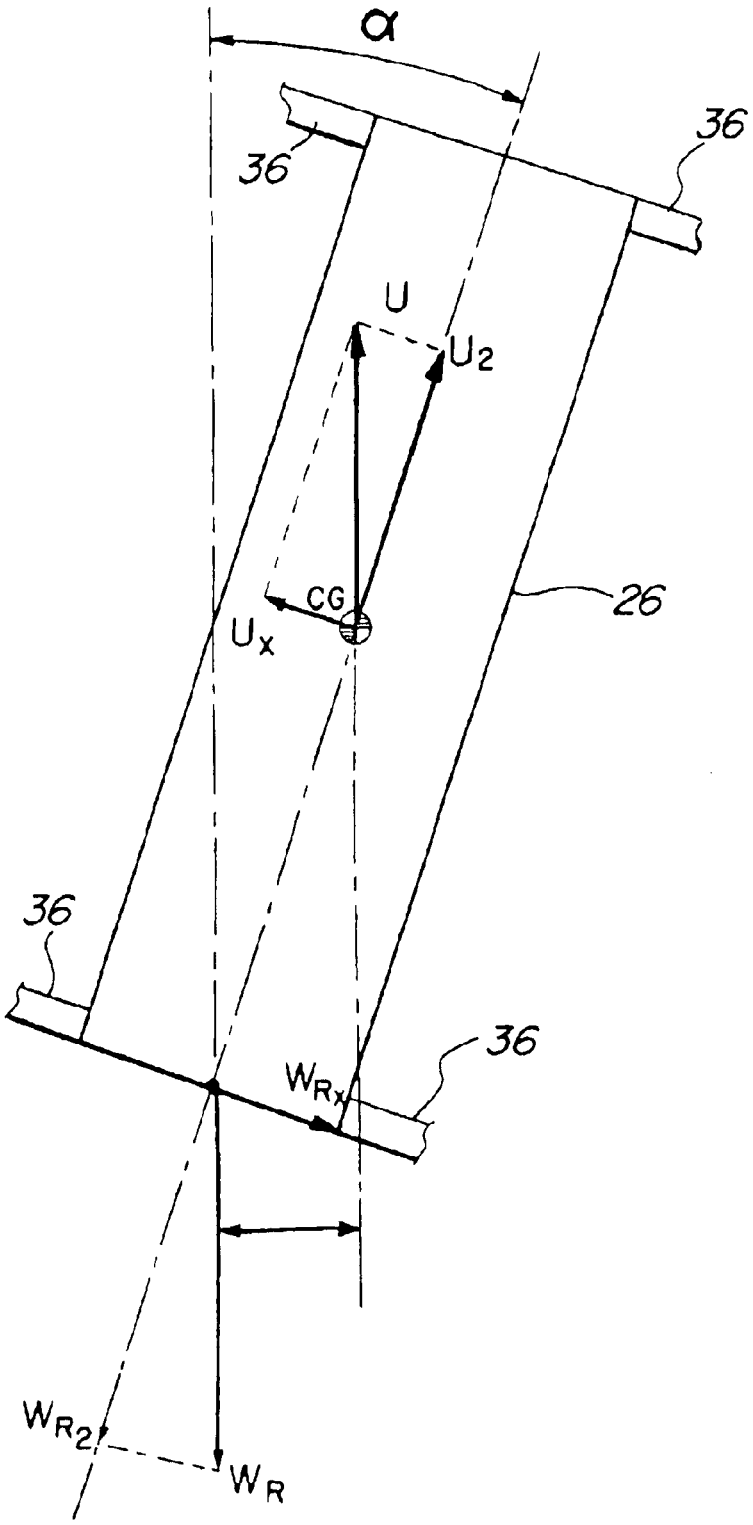
FIG. 5 is a diagrammatic view showing the creation of a restoring moment in the buoy.

FIG. 5 is a schematic drawing showing how the present invention improves the pitch motion of the deep draft semi-submersible platform. One of the advantages of the present invention is that, because the buoy 26 is guided at two vertically spaced locations, the contact loads between the buoy and the platform while the deep draft semi-submersible platform is pitching (rotation around the horizontal axis), create a restoring moment that reduces the pitch motion of the platform. FIG. 5 shows the buoy 26 and its environment (guides) when the platform pitches at a pitch angle $\alpha$. The buoyancy of the buoy 26 provides an uplift force (U) which applies at the center of gravity (CG) of the buoy 26. The weight of the riser ($W_R$), because the risers are at least in contact with the lower part of the buoy 26, will apply at the lower part of the buoy. As the buoy 26 is pitching, the application points of these forces are horizontally offset, and consequently the horizontal resulting forces (Ux and $W_{RX}$) in the oblique two dimensional planes (defined by the longitudinal axis of the buoy when tilting) are opposed. Because the buoy 26 is guided in upper and lower locations, the buoy is restrained in rotation by the platform, and the contact loads in the upper and lower guides will correspond to the horizontal resulting forces and create a moment. Since the weight of the risers is borne by to the lower part of the buoy, the created moment opposes the pitching motion of the platform and thus reduces the pitch angle $\alpha$. The restoring moment is proportional to the uplift force of the buoy. Calculations have shown that the present invention can result in a 20% to 60% reduction in the pitch motion of the platform.

It is important to note that if the weight of the riser is borne at the top of the buoy, the resulting moment will increase the pitch angle and thus deteriorate the motion of the platform.

FIGS. 6A to 6D show the different steps of the installation method of the platform of the present invention. In accordance with this method, the central columnar buoy 26 is provided with an upper stop assembly 90 and a lower stop assembly 92 to limit the vertical motion of the buoy between upper and lower positions when it is ballasted up or down, respectively, during installation, as described below.

Figure 6A:
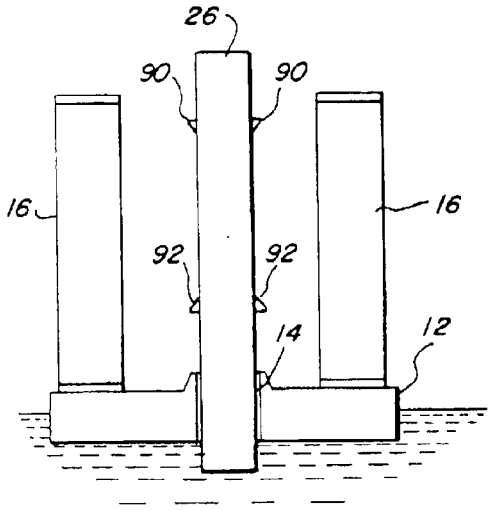
FIGS. 6A to 6D show the different steps of the installation of the platform, in accordance with the method of the invention.
Figure 6B:
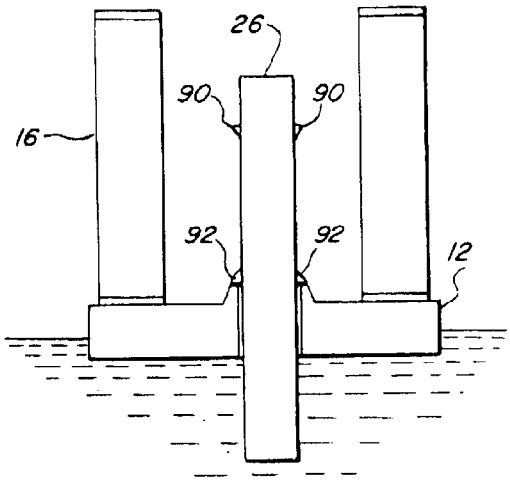

As shown in FIG. 6A, an assembly is provided that comprises a buoyant base 12, plural vertical outer buoyancy columns 16, and a central columnar buoyancy apparatus 26. The central buoyancy apparatus 26 centrally located in the base 12, and it is movable vertically relative to the base 12 from an upper position to a lower position. The assembly is towed at a shallow draft to a first site with the central columnar buoyancy apparatus 26 in its upper position. Upon arrival at the first site, as shown in FIG. 6B, the center columnar buoyancy apparatus 26 is ballasted down through the base 12 to its lower position, at which the lower stop assembly 92 abuts against the base 12.

Figure 6C:
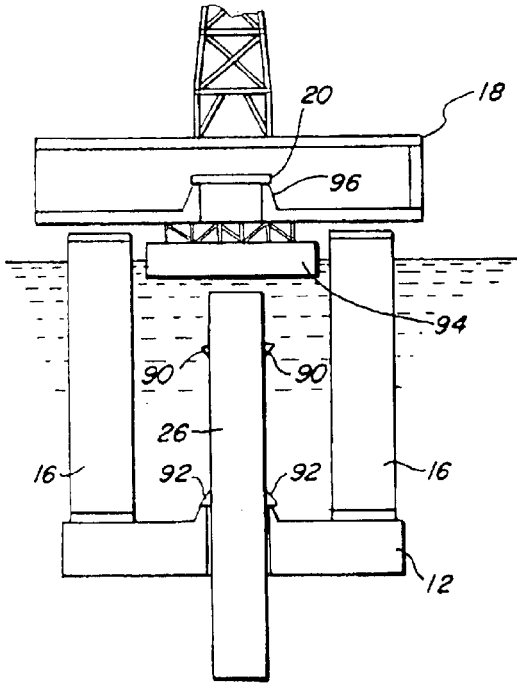
Figure 6D:
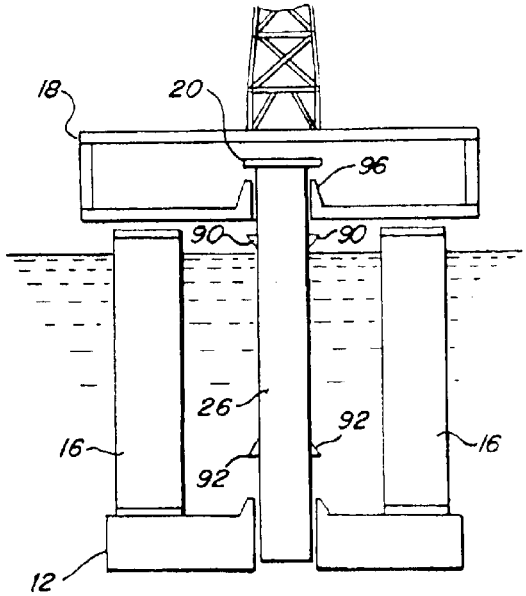

Then, as shown in FIG. 6C, the base 12 is ballasted down to a first depth such that the outer buoyancy columns 16 extend just above the sea surface. A deck structure (production deck 18 and well deck 20), supported by a deck barge 94, is floated over the base 12, the central buoyancy apparatus 26, and the outer buoyancy columns 16. At this stage, the well deck is seated on a rim 96 surrounding the upper moon pool 22. The outer buoyancy columns 16 are the deballasted to lift the deck structure off the barge 94, which is then removed, and the production deck 18 is secured to the outer columns 16, thereby forming a platform 10. Finally, as shown in FIG. 6D, the central columnar buoyancy apparatus 26 is deballasted to raise it to its upper operating position, at which the upper stop assembly 90 abuts against the underside of the deck structure. As the central buoyancy apparatus 26 rises to its operating position, it lifts the well deck 20 off the upper moon pool rim 96 to the raised operational position of the well deck 20.

With the platform in the configuration shown in FIG. 6D, it is towed to a second (operational) site at an intermediate draft. The entire platform is then ballasted down to an operational draft and anchored to the seabed by conventional anchoring means, such as a taut leg mooring system.

The central buoyancy apparatus will not be protected by a center well in the splash zone, and will be subjected to wave and current action, which can lead to VIV problems. Because the diameter of the vertically restrained central buoyancy apparatus 26 is large compared to the diameter of a typical riser, the tension of the riser system can be designed to limit this VIV problem. If need be, VIV strakes can be arranged on the outer periphery of the buoy 26. However only one set of VIV strakes will be required, and not one set for each riser.

It will be appreciated that the central buoyancy apparatus 26 can be vertically restrained by the risers themselves or by a central tendon (not shown). The buoyancy apparatus 26 supports the well deck 20, and high-pressure flexible jumpers (not shown) are used for connection to the production deck 18. Alternatively, the well deck 20 may include a manifold (not shown) to which the petroleum will be carried and pressure choked down, and a low-pressure jumper (not shown) can be used to carry the petroleum product to the production deck. The buoyancy apparatus 26 can also support the drilling deck. Furthermore, the risers and/or tendons will act together as a single riser system.

What is claimed is:

1. A semi-submersible platform, comprising:

a base having a first moon pool;

a plurality of vertical outer buoyancy columns extending upwardly from the base;

a deck structure supported by the buoyancy columns and having a second moon pool;

a central columnar buoyancy apparatus that is guided within the first and second moon pools for vertical movement between an upper position and a lower position relative to the base and the deck structure;

an upper stop assembly on the buoyancy apparatus that is engageable against the deck structure when the buoyancy apparatus is in its upper position;

a lower stop assembly on the buoyancy apparatus that is engageable against the base when the buoyancy apparatus is in its lower position; and a riser passing through the buoyancy apparatus and horizontally restrained within the buoyancy apparatus below the center of gravity thereof.

2. The semi-submersible platform of claim 1, wherein at least two vertical risers pass through the central columnar buoyancy apparatus and are horizontally restrained below the center of gravity thereof.

3. The semi-submersible platform of claim 1, wherein the base is buoyant.

4. The semi-submersible platform of claim 1, wherein the central columnar buoyancy apparatus has a lower portion, and wherein the riser is attached to the central columnar buoyancy apparatus within the lower portion thereof.

5. The semi-submersible platform of claim 4, wherein the central columnar buoyancy apparatus has an upper portion, and wherein the riser is attached to the buoyancy apparatus within the upper portion thereof.

6. The semi-submersible platform of claim 1, wherein the central columnar buoyancy apparatus comprises multiple compartments.

7. The semi-submersible platform of claim 1, wherein the central columnar buoyancy apparatus is guided within each of the first and second moon pools by a plurality of guide assemblies.

8. The semi-submersible platform of claim 7, wherein the guide assemblies are complaint.

9. The semi-submersible platform of claim 7, wherein the guide assemblies maintain substantially constant contact with the central columnar buoyancy apparatus.

10. The semi-submersible platform of claim 7, wherein each of the guide assemblies includes a wear pad that engages the central columnar buoyancy apparatus.

11. The semi-submersible platform of claim 7, wherein each of the guide assemblies includes a roller that engages the central columnar buoyancy apparatus.

12. The semi-submersible platform of claim 11, wherein the central buoyancy apparatus includes a plurality of vertical rails on the periphery thereof, each of the rails being positioned for engagement by one of the rollers.

13. The semi-submersible platform of claim 7, wherein the guide assemblies include a plurality of wear pads on the periphery of the central columnar buoyancy apparatus.

14. The semi-submersible platform of claim 7, wherein each of the guide assemblies comprises a guide module that is lockably installable within one of the moon pools.

15. The semi-submersible platform of claim 1, wherein the buoyancy apparatus includes structure that defines an internal moon pool.

16. The semi-submersible platform of claim 1, wherein the platform includes a well deck that is supported by the buoyancy apparatus.

17. A method of installing a floating, semi-submersible platform at an operational site on the sea surface over the seabed, comprising the steps of:

(a) providing an assembly comprising a buoyant base having a plurality vertical outer buoyancy columns upwardly therefrom, and a central columnar buoyancy apparatus located centrally within the base, the central columnar buoyancy apparatus being movable vertically relative to the base between an upper position and a lower position;

(b) towing the assembly at a shallow draft to a first site with the central columnar buoyancy apparatus in its upper position;

(c) ballasting down the central columnar buoyancy apparatus to its lower position;

(d) ballasting down the base to a first draft such that the outer buoyancy columns extend just above the sea surface;

(e) floating a deck structure over the base, the outer buoyancy columns, and the central columnar buoy;

(f) deballasting the outer columns to lift the deck structure;

(g) deballasting the central columnar buoyancy apparatus to raise it to its upper position in which it engages the deck structure to form a platform;

(h) towing the platform to a second site at an intermediate draft;

(i) ballasting down the platform to an operational draft; and (j) anchoring the platform to the seabed.

18. The method of claim 17, wherein the central columnar buoyancy apparatus includes an upper stop assembly and a lower stop assembly, and wherein the step of ballasting down the buoyancy apparatus is performed until the lower stop assembly abuts against the base, and wherein the step of deballasting the buoyancy apparatus is performed until the upper stop assembly abuts against the deck structure.

* * * * *